US007204725B2

(12) United States Patent
Yamashita

(10) Patent No.: US 7,204,725 B2
(45) Date of Patent: Apr. 17, 2007

(54) CONNECTOR AND METHOD OF ASSEMBLING IT

(75) Inventor: Kazunori Yamashita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/221,659

(22) Filed: Sep. 8, 2005

(65) Prior Publication Data

US 2006/0052004 A1 Mar. 9, 2006

(30) Foreign Application Priority Data

Sep. 9, 2004 (JP) ..... 2004-262219

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS 5,437,565 A 8/1995 Atsumi et al.
5,634,826 A * 6/1997 Jean et al. ..... 439/752
5,848,919 A * 12/1998 Nagano ..... 439/752
6,010,374 A * 1/2000 Miwa ..... 439/752
6,036,552 A * 3/2000 Atsumi ..... 439/752
6,652,328 B2 * 11/2003 Suzuki ..... 439/752
6,702,628 B2 * 3/2004 Tanaka et al. ..... 439/752
6,752,660 B2 * 6/2004 Fujita et al. ..... 439/595
6,769,934 B2 * 8/2004 Nakamura et al. ..... 439/595
6,780,070 B2 * 8/2004 Ishikawa et al. ..... 439/752
6,902,443 B2 * 6/2005 Hara et al. ..... 439/752

* cited by examiner

*Primary Examiner*—Gary F. Paumen
(74) *Attorney, Agent, or Firm*—Gerald E. Hespos; Anthony J. Casella

(57) ABSTRACT

A shielded terminal (20) is inserted into a cavity (31) of a female housing (30) while inserting stabilizers (28) bulging out to left and right sides therefrom along guide grooves (40), and is partly locked by a locking portion (35). A retainer (50) is inserted into a retainer mount hole (42) while inserting legs (52) at the opposite sides into insertion grooves (44). When the retainer (50) is pushed to a full locking position, retaining portions (54) are engaged with the rear edges of the stabilizers (28) to doubly lock the shielded terminal (20). The retainer (50) is locked at the full locking position by the resilient engagement of full locking claws (58) with full locking sections (48) as well as by the fitting engagement of elongated locking projections (60) formed on the inner surfaces of the leg pieces (52) with end portions of the guide grooves (40).

10 Claims, 14 Drawing Sheets

CONNECTOR AND METHOD OF ASSEMBLING IT

BACKGROUND OF THE INVENTION

1. Field of the Invention

The invention relates to a connector with a retainer for locking a terminal fitting and to a method of assembling it.

2. Description of the Related Art

U.S. Pat. No. 5,437,565 and FIG. 16 herein disclose a connector with a retainer for locking a terminal fitting. As shown in FIG. 16, this connector has terminal fittings 1 inserted into cavities 2 of a housing 3. The connector also has a retainer 4 with retaining portions 5 that engage the terminal fittings 1 in the cavities 2. The housing is formed with insertion grooves 6 that receive legs 7 of the retainer 4. Each leg 7 includes a pair of resiliently deformable partial and full locking claws 8A, 8B.

The partial locking claws 8A engage partial locking sections 9A, as shown in solid line in FIG. 16(B), to lock the retainer 4 at a partial locking position where the retaining portions 5 are below the cavities 2. Thus, the terminal fittings 1 can be inserted into the cavities 2 and partly locked by locks in the housing 3. The retainer 4 then can be pushed to a full locking position so that the full locking claws 8B engage full locking sections 9B, as shown in phantom line in FIG. 16(B). The retaining portions 5 project into the cavities 2 to engage jaws 1A of the inserted terminal fittings 1 when the retainer 4 is at the full locking position. As a result, the terminal fittings 1 are locked doubly.

There has been a gradual demand to miniaturize the terminal fittings 1 and the housing 3. As a result, the retainer 4 also has to be miniaturized. However, a reduction in size of the above-described retainer 4 will reduce the rigidity of the locking claws 8B, 8A and the locking margins will be smaller. This may result in insufficient locking strength and, therefore, insufficient forces for locking the terminal fittings 1.

In view of the above problem, an object of the present invention is to ensure sufficient strength for locking a retainer at a locking position.

SUMMARY OF THE INVENTION

The invention relates to a connector that has a housing with at least one cavity for receiving a terminal fitting. A retainer is insertable into the housing for retaining the terminal fitting. The retainer has at least one leg that is insertable into an insertion groove formed in a side wall of the cavity. A lock is provided on the leg and is resiliently engageable with an engaging portion in the insertion groove to lock the retainer at a locking position where the retainer retains the terminal fitting. An auxiliary locking mechanism has at least one projection and at least one recess formed on surfaces of the leg and the insertion groove substantially facing each other and engage each other when the retainer is inserted to the locking position.

The retainer is locked strongly at the locking position by the engagement of the lock with the engaging portion as well as by the engagement of the projection and the recess of the auxiliary locking mechanism between the facing surfaces of the leg and the insertion groove. Further, the locking mechanism on the facing surfaces of the leg and the insertion groove is in a dead space and does not enlarge the housing.

Thus, the locking strength of the retainer, i.e. a force for locking the terminal fitting, is reinforced while keeping the size of the connector small.

The auxiliary locking mechanism preferably includes a projection on either a surface of the leg of the retainer facing the cavity or a facing surface of the insertion groove, and a recess formed in the other surface thereof. The projection is insertable into the recess to effect another locking for the retainer when the retainer is inserted to the locking position.

The terminal fitting preferably includes at least one outwardly projecting stabilizer. A guide groove is formed in a wall of the cavity for receiving the stabilizer and communicates with the insertion groove. An end of the guide groove towards the insertion groove preferably is the recess.

The projection of the leg fits in the guide groove when the retainer is inserted to the locking position to achieve another locking for the retainer.

The guide groove preferably becomes narrower when seen in an inserting direction of the terminal fitting into the cavity.

The retainer preferably pushes the terminal fitting towards the properly inserted position as the retainer is mounted to the locking position. More particularly, the projection of the leg preferably pushes the stabilizer.

The retainer preferably presses the terminal fitting against the side wall of the cavity at the opposite side to prevent the terminal fitting from shaking in the cavity.

The retainer preferably includes a pair of lateral legs and a pair of insertion grooves are provided at the lateral sides of the cavity. Stabilizers project to lateral sides from the terminal fitting and guide grooves are formed in opposite side walls of the cavity for receiving the respective stabilizers. The guide grooves communicate with the insertion grooves, and the projections of both legs fit into the corresponding guide grooves to hold the stabilizers from opposite sides when the retainer is inserted to the locking position.

The stabilizer of the terminal fitting is pressed from substantially opposite sides by a pair of projections. Thus, the terminal fitting is prevented from shaking while being centered in the cavity.

The retainer preferably can be locked at a temporarily holding position before the locking position with respect to an inserting direction of the retainer. The terminal fittings can be inserted or withdrawn when the retainer is at the temporary holding position. Thus, the retainer can be handled more easily, which enables more efficient inserting operation and maintenance.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
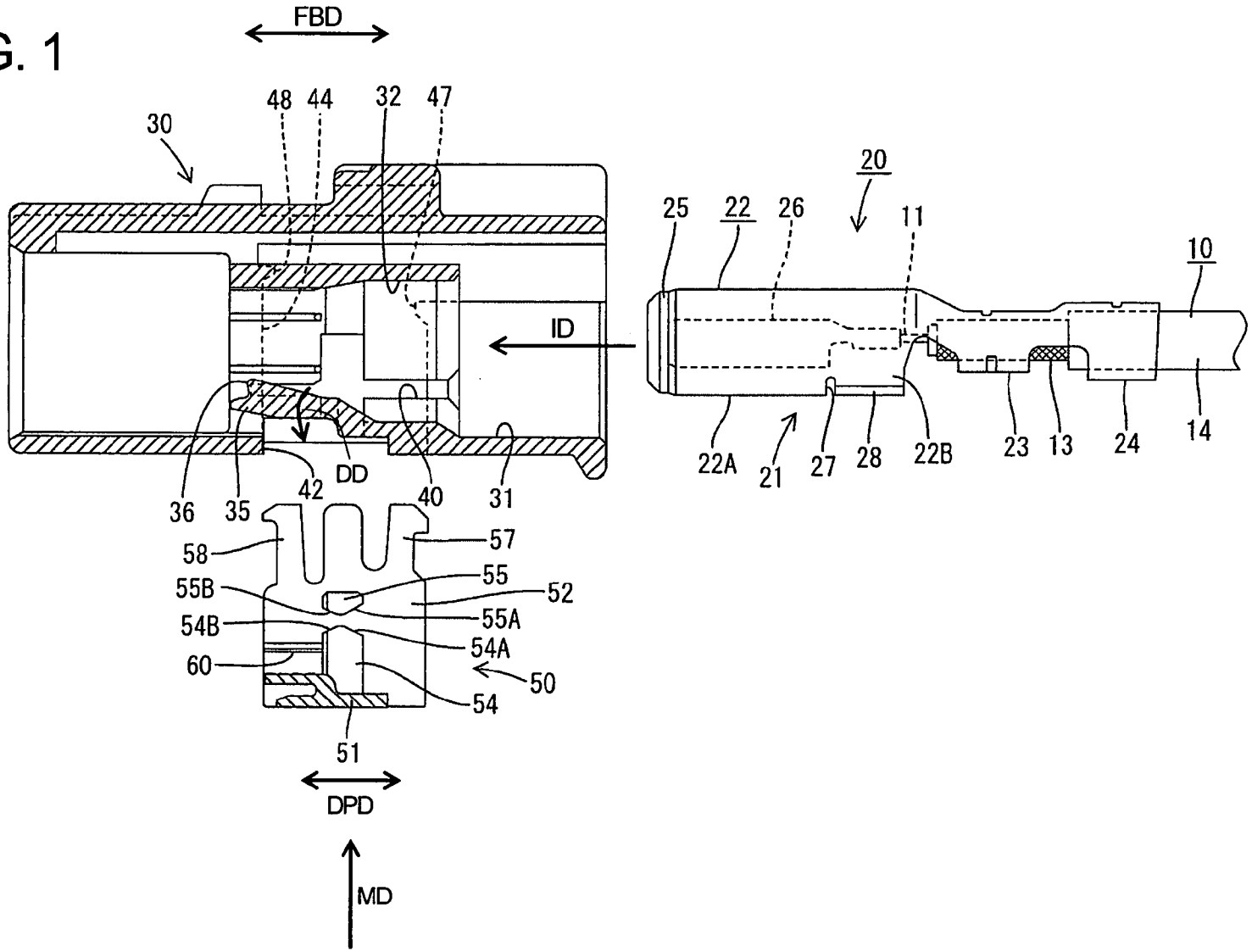
FIG. 1 is an exploded longitudinal section showing one embodiment of the invention.
Figure 2:
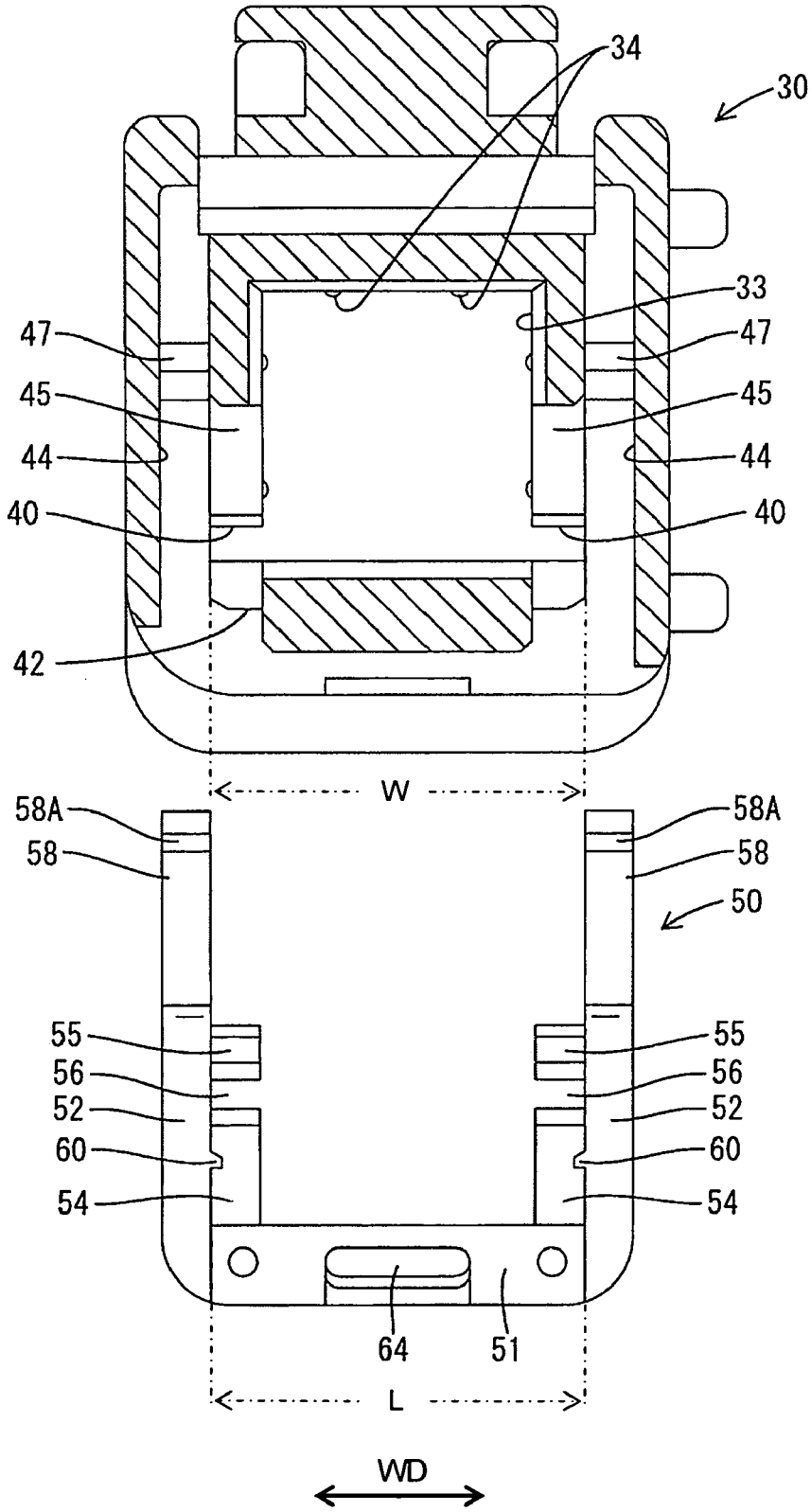
FIG. 2 is a front view in section showing a state before a retainer is mounted into a female housing.

A female shielded connector according to the invention is illustrated in FIGS. 1 through 15. The end of the connector that is to be connected with a mating connector is the left side in FIG. 1 and is referred to herein as the front.

The connector has a shielded terminal 20, as shown in FIGS. 1 through 4. The shielded terminal 20 has an outer terminal 21 made of a metal plate. A rectangular tubular accommodating portion 22 is formed at the leading end of the outer terminal 21, and front and rear barrels 23, 24 are formed behind the accommodating portion 22. A thick rectangular tubular dielectric element 25 is fit in the accommodating portion 22 and is made of an insulating material, such as a synthetic resin.

An inner female terminal 26 made of a metal plate is secured to an end of a core 11 of a shielded wire 10 and is fit into the dielectric element 25. The front barrel 23 is crimped, bent or folded into connection with an end of an exposed shielding layer 13, such as a braided wire, and the rear barrel 24 is crimped, bent or folded into connection with an end of a sheath 14.

Figure 3:
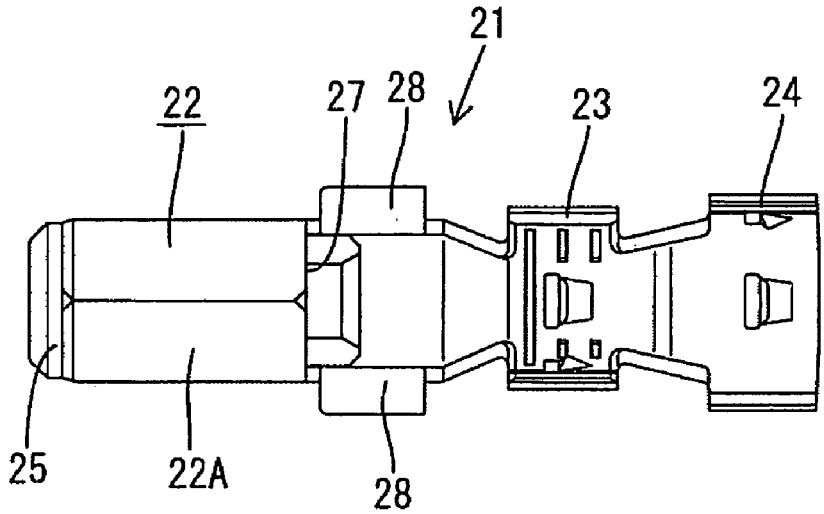
FIG. 3 is a plan view of a shielded terminal.
Figure 4:
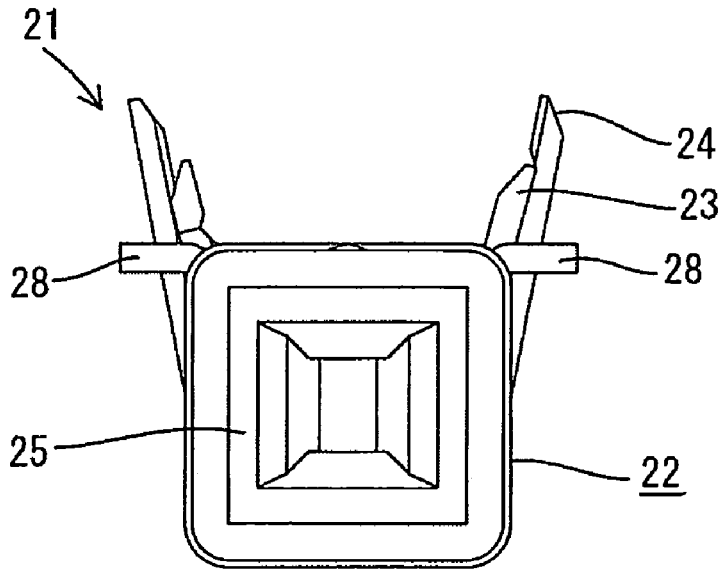
FIG. 4 is a front view of the shielded terminal.
Figure 5:
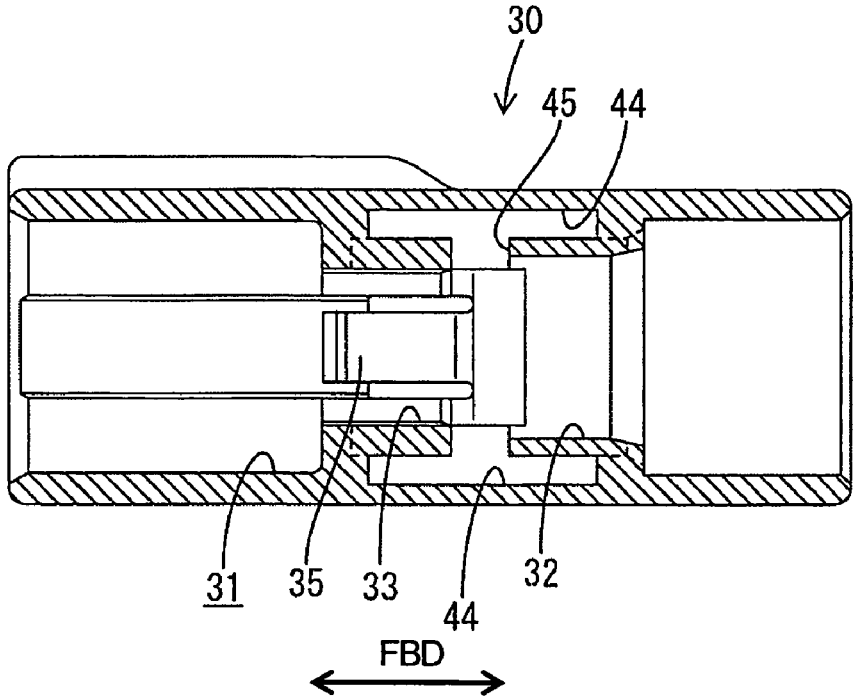
FIG. 5 is a plan view in section of the female housing.
Figure 6:
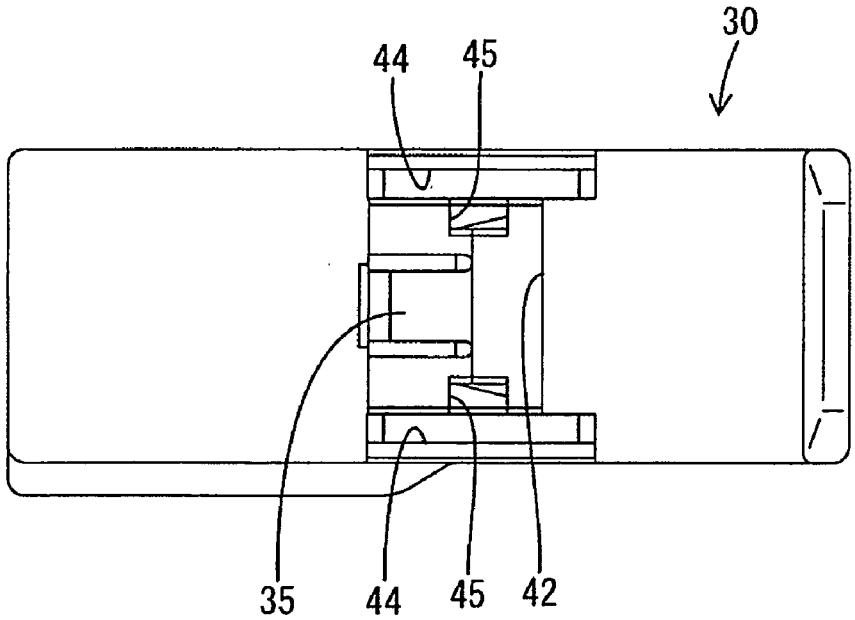
FIG. 6 is a bottom view of the female housing.

The accommodating portion 22 of the outer terminal 21 has a ceiling plate 22A that is cut off to define a locking edge 27, as shown in FIG. 3. The accommodating portion 22 also has opposed side plates 22B. Upper ends of side plates 22B are bent out at substantially right angles to define stabilizers 28 in a rear portion of the accommodating portion 22 where the ceiling plate 22A is cut out. The stabilizers 28 prevent the shielded terminal 20 from being inserted in the wrong posture. In this regard, the shielded terminal 20 is in the proper posture when the ceiling plate 22A and the stabilizers 28 of the accommodating portion 22 of the outer terminal 21 are faced down, as shown in FIG. 1.

The connector also has a female housing 30 made e.g. of a synthetic resin. The female housing 30 is a generally rectangular tube that is narrow and long in forward and backward directions FBD, as shown in FIGS. 5 to 9. A cavity 31 is formed inside of the female housing 30 and the shielded terminal 20 is insertable from behind into the cavity 31 in an inserting direction ID that is substantially parallel to the forward and backward directions FBD.

Figure 7:
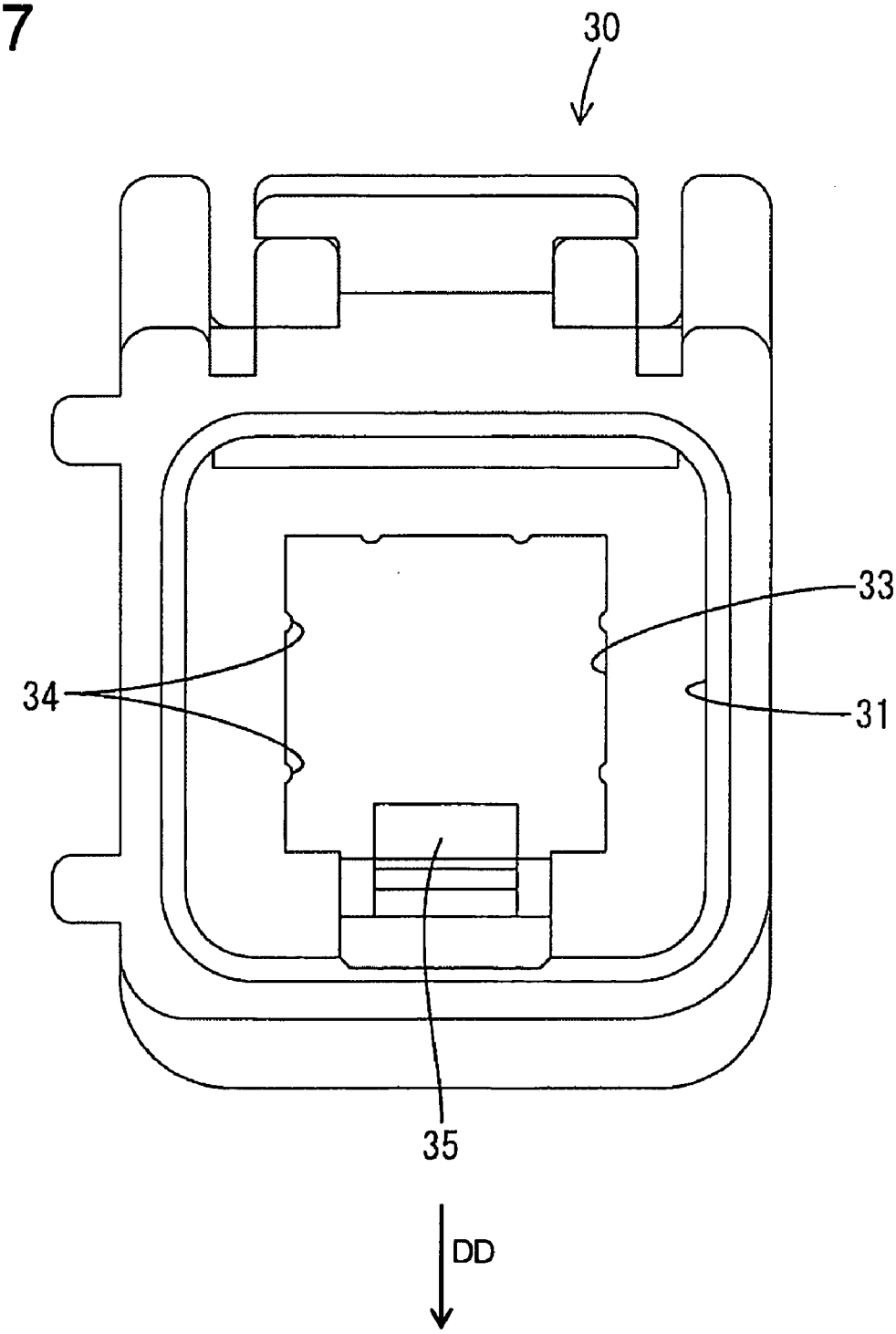
FIG. 7 is a front view of the female housing.
Figure 8:
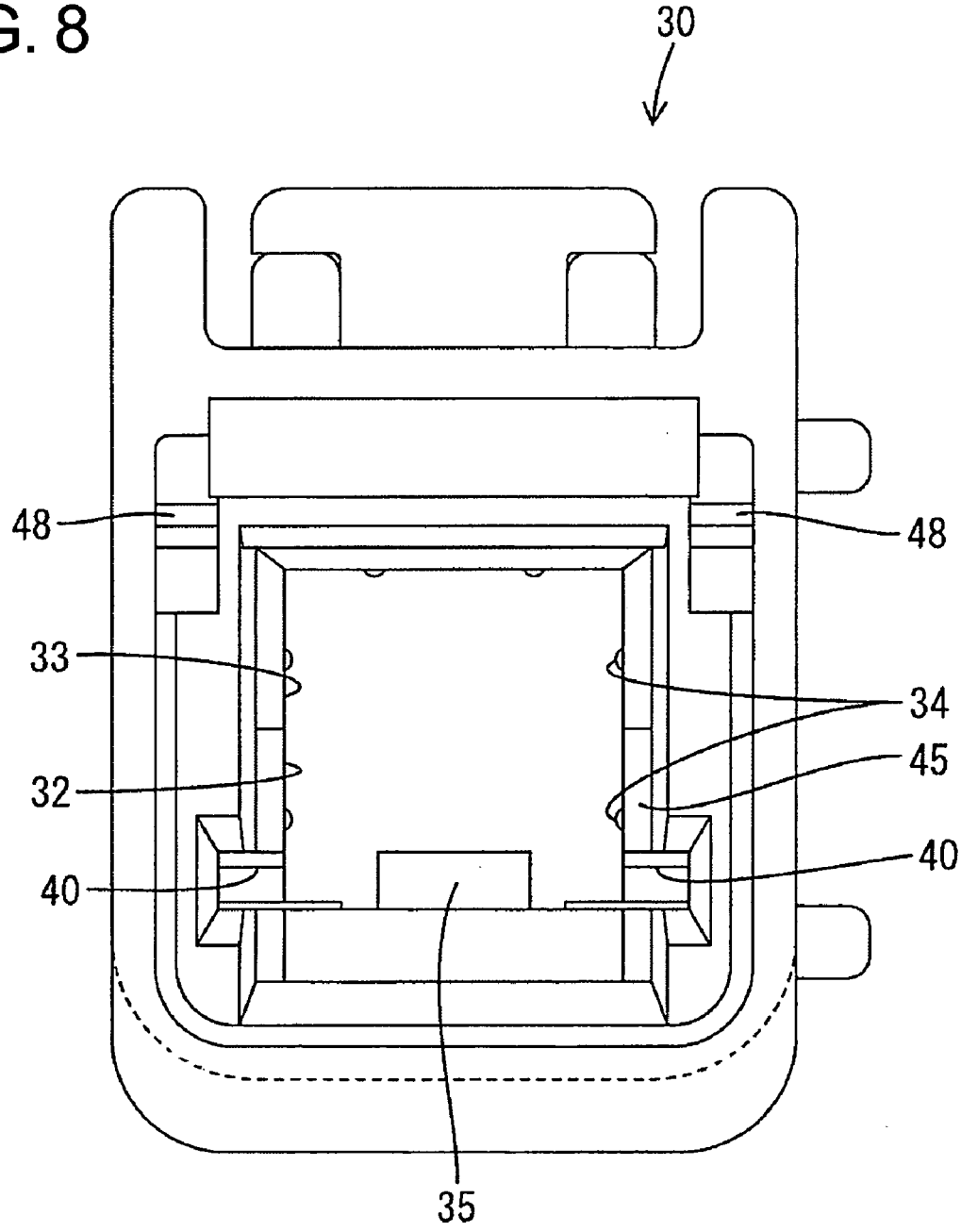
FIG. 8 is a rear view of the female housing.
Figure 11:
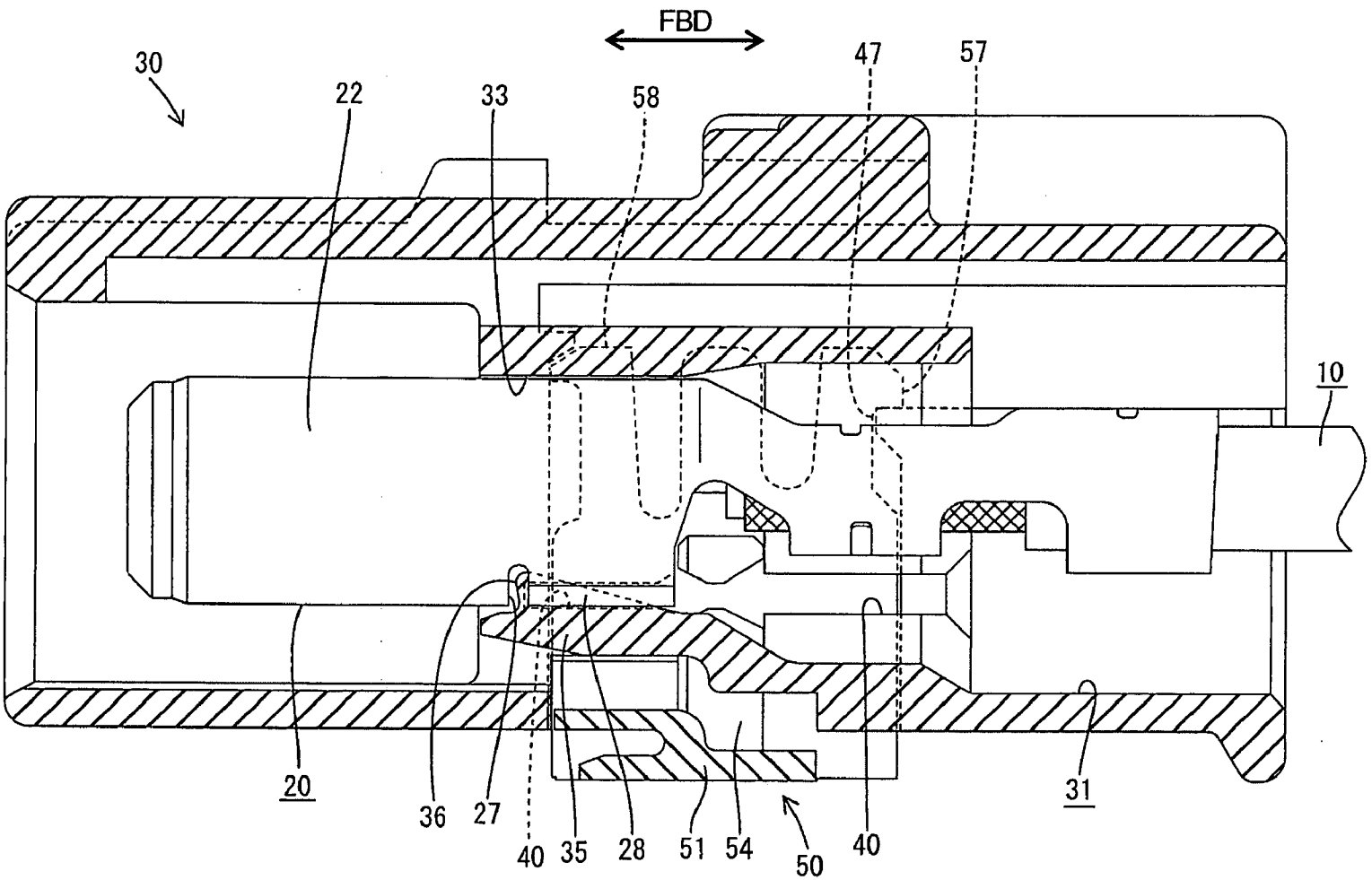
FIG. 11 is a longitudinal section showing the shielded terminal partly locked.

A narrowed portion 32 of substantially rectangular cross section is formed in a longitudinal middle of the cavity 31. A fitting portion 33 is formed in a front part of the narrowed portion 32 and is closely fittable to the rear end of the accommodating portion 22 of the outer terminal 21, as shown in FIG. 11. Two substantially elongated shake-preventing projections 34 are formed on each of the lateral surfaces of the fitting portion 33, as shown in FIG. 7, and extend substantially in forward and backward directions FBD.

A lock 35 is cantilevered forward at the bottom surface of the fitting portion 33, and a front end of the lock 35 is resiliently deformable up and down in a deforming direction DD that intersects the inserting direction ID. Alternatively, the lock 35 could be supported at front and rear ends to define a bridge like configuration. In such case, an intermediate portion of the lock could deform and shift in the deforming direction substantially normal to the inserting direction ID. A protrusion 36 is formed on the inner (upper) surface of the lock 35 and is engageable with the locking edge 27 of the shielded terminal 20.

Guide grooves 40 extend substantially along the forward and backward directions FBD at bottom positions of the lateral walls of the narrowed portion 32. The guide grooves 40 are open at the rear surface of the narrowed portion 32 and can slidably receive the stabilizers 28 of the shielded terminal 20. However, the guide grooves 40 are closed at positions slightly retracted from the front surface, as shown in FIG. 1. Ceiling surfaces of the guide grooves 40 are higher at the rear end than at the front end. Thus, the guide grooves 40 are wider at the rear end than at the front end, and have a converging shape towards the front, as seen in the inserting direction ID.

The shielded terminal 20 is inserted into the cavity 31 from behind and advances into the narrowed portion 32 in the inserting direction ID while the stabilizers 28 slide along the guide grooves 40. At this time, the front edge of the ceiling plate 22A of the accommodating portion 22 pushes the lock 35 and deforms the lock 35 in the deforming direction DD. The insertion of the shielded terminal 20 is stopped when the stabilizers 28 contact the closed ends of the guide grooves 40. The locking edge 27 of the accommodating portion 22 passes the protrusion 36 of the lock 35 substantially at this time. Thus, the lock 35 returns resiliently and the protrusion 36 engages the locking edge 27 from behind. Accordingly, the shielded terminal 20 is locked partly in such a direction as not to come out of the cavity 31.

A retainer mount hole 42 is formed in the bottom surface of the female housing 30 at a position substantially aligned with the narrowed portion 32 of the cavity 31.

The connector also has a retainer 50 made e.g. of a synthetic resin. The retainer 50 has a base plate 51 and two legs 52 project from opposite ends of the base plate 51. The base plate 51 has a length L slightly longer than the width W of the narrowed portion 32 of the cavity 31, and the legs 52 have a depth D slightly larger than the depth DBP of the base plate 51.

Retaining portions 54 are formed on surfaces of the two legs 52 that face each other and are engageable with the rear edges of the stabilizers 28 of the shielded terminal 20. The retaining portions 54 are at bottom end positions in a substantially middle part with respect to a depth direction DPD that is substantially parallel to the forward and backward directions FBD. Each retaining portion 54 is vertically long and has a specified thickness. A guiding projection 55 is at a position separated up from each retaining portion 54 by a specified distance, and hence is more towards the front as seen in the mounting direction MD of the retainer 50 into the housing 30.

Figure 9:
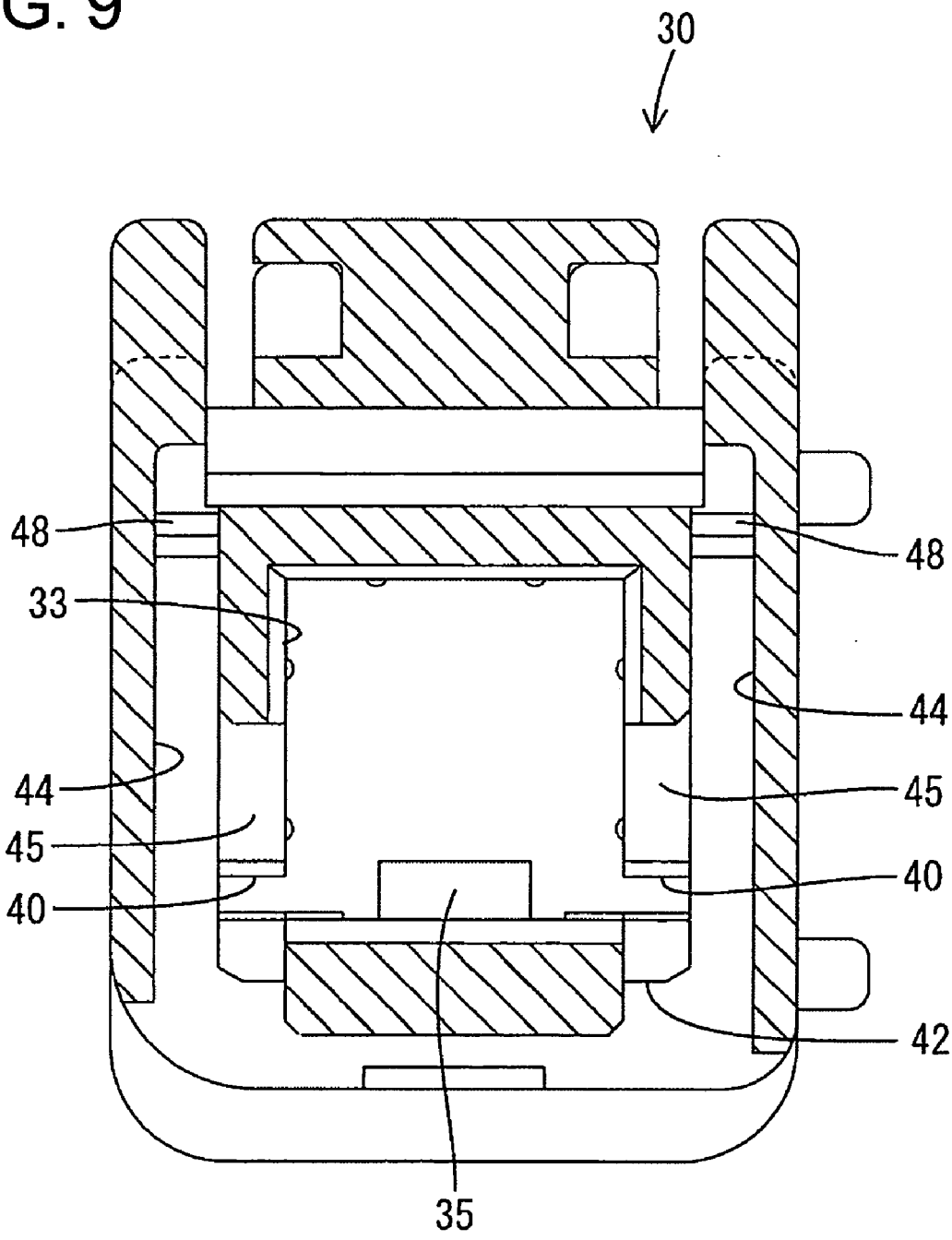
FIG. 9 is a rear view in section of the female housing.

Insertion grooves 44 are formed in the lateral walls of the narrowed portion 32 of the cavity 31, as shown in FIG. 9, and closely receive the legs 52 of the retainer 50. The insertion grooves 44 communicate with the opposite sides of the retainer mount hole 42, and hence open in the bottom surface of the female housing 30. Substantially vertical grooves 45 cross the guide grooves 40 for the stabilizers 28 and intersect the insertion grooves 44 in the lower portion of the inner side surfaces of the lateral side walls in an intermediate part with respect to the forward and backward directions FBD.

The guiding projections 55 and the retaining portions 54 enter the corresponding vertical grooves 45 from below and in the mounting direction MD when the leg pieces 52 of the retainer 50 are inserted into the insertion grooves 44. The rear side of the upper edge of each retaining portion 54 and the rear part of the bottom edge of the corresponding guiding projection 55 have slanted surfaces 54A, 55A that widen a spacing therebetween toward the back. However, the front side of the upper edge of each retaining portion 54 and the front part of the bottom edge of the corresponding guiding projection 55 have slanted surfaces 54B, 55B that widen a spacing therebetween toward the front (see e.g. FIG. 1).

Figure 10:
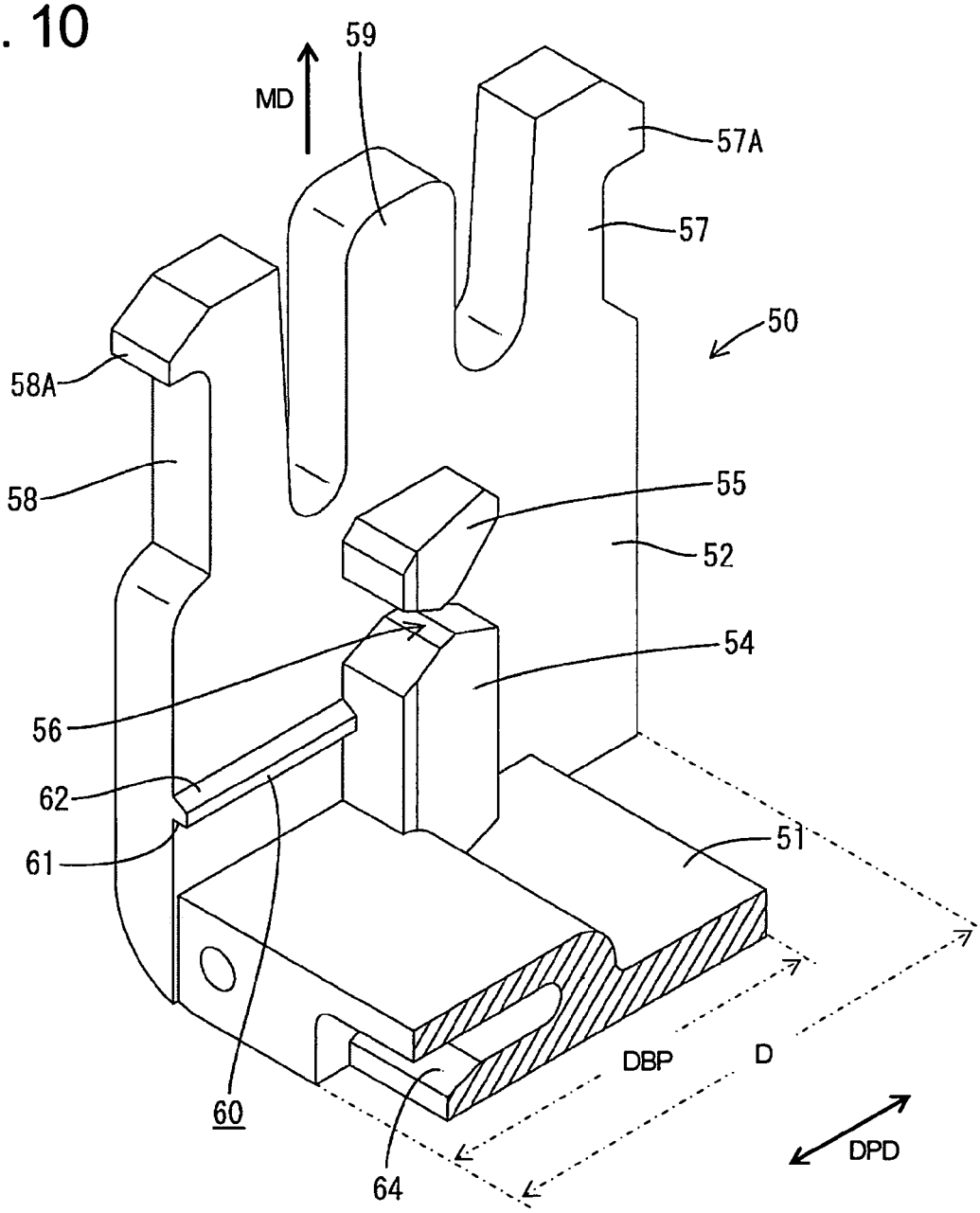
FIG. 10 is a partial perspective view of the retainer.

Partial and full locking claws 57, 58 extend up at upper rear and front sides of each leg 52 of the retainer 50. As shown in FIG. 10, a claw 57A, 58A extends laterally out at the leading end of each locking claw 57, 58. The claw 57A, 58A has a substantially horizontal locking surface arranged substantially normal to the mounting direction MD at its bottom or rear end as seen in the mounting direction MD and a slanted surface at its top or front end as seen in the mounting direction MD. The locking claws 57, 58 are resiliently deformable towards and away from each other. An excessive deformation preventing portion 59 is provided between the two locking claws 57 and 58.

A partial locking section 47 projects at a relatively low position (right edge of FIG. 1) of each insertion groove 44 and is engageable with the partial locking claw 57. Further, a full locking section 48 projects at a relatively high position at the front edge of the insertion groove 44 and is engageable with the full locking claw 58.

Horizontal locking surfaces are formed on the upper side of the locking sections 47, 48 and are arranged substantially normal to the mounting direction MD. Slanted surfaces are formed on the bottoms of the locking sections 47, 48. Open spaces are defined above the respective locking sections 47, 48 to let the corresponding locking claws 57, 58 escape.

Figure 12:
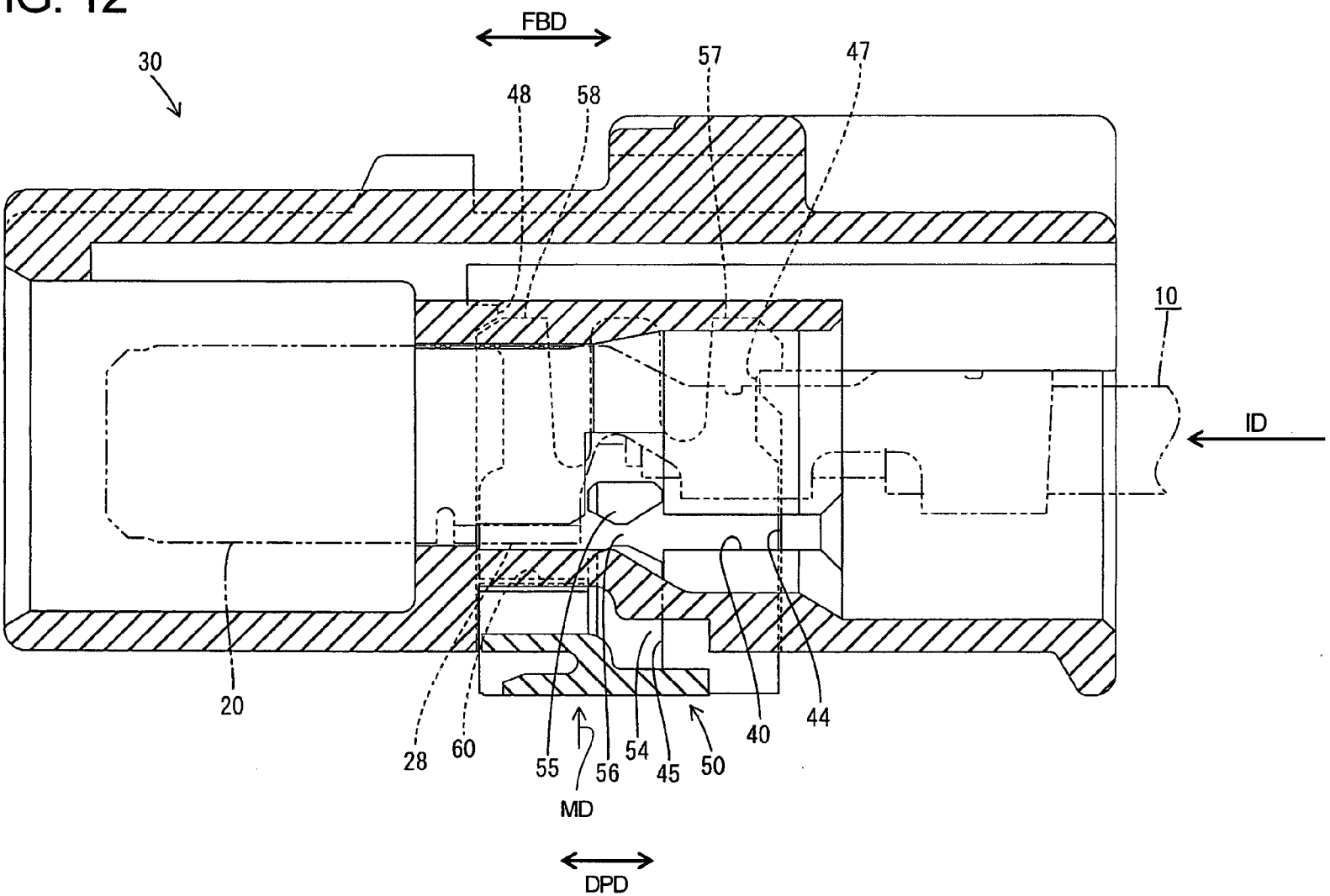
FIG. 12 is a longitudinal section showing a state where the retainer is at a partial locking position.

The retainer 50 is pushed in the mounting direction MD into the retainer mount hole 42 with the legs 52 inserted in the insertion grooves 44. Thus, the partial locking claws 57 first engage resiliently with the partial locking sections 47, as shown in FIG. 12. As a result, the retainer 50 is located at the partial locking position where the insertion depth of the retainer 50 is small. At this partial locking position, clearances 56 between the retaining portions 54 and the guiding projections 55 align with the guide grooves 40 for the stabilizers 28 so that the stabilizers 28 can slide along the guide grooves 40.

Figure 14:
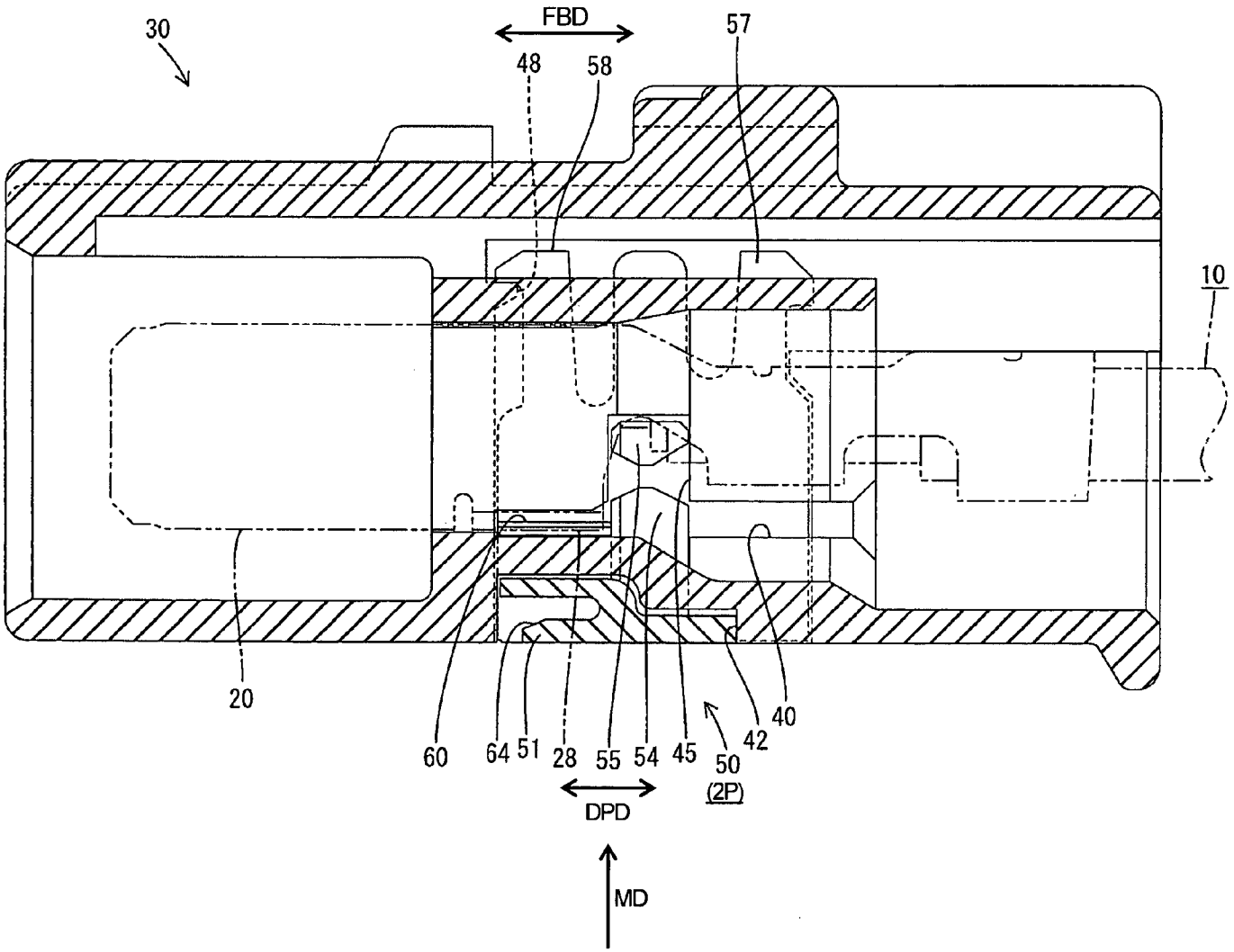
FIG. 14 is a longitudinal section showing a state where the retainer is at a full locking position.

The retainer 50 then is pushed farther in the mounting direction MD until the base plate 51 of the retainer 50 is fit in the retainer mount hole 42 and is substantially flush with the outer surface of the female housing 30. Thus, the full locking claws 58 engage the full locking sections 48, as shown in FIG. 14, to lock the retainer 50 at the full locking position. At this full locking position, the upper ends of the retaining portions 54 cross the guide grooves 40 and project substantially up therefrom.

Elongated locking projections 60 are formed on the inner facing surfaces of the legs 52 of the retainer 50 slightly below the upper ends of the retaining portions 54, as shown in FIGS. 1 and 10. The locking projections 60 extend horizontally and substantially normal to the mounting direction MD at positions before from the retaining portions 54. A substantially horizontal locking surface 61 is formed on the bottom of each locking projection and the upper surface thereof is formed into a slanted surface 62 is formed on the top of each locking projection, as shown in FIG. 13.

Figure 13:
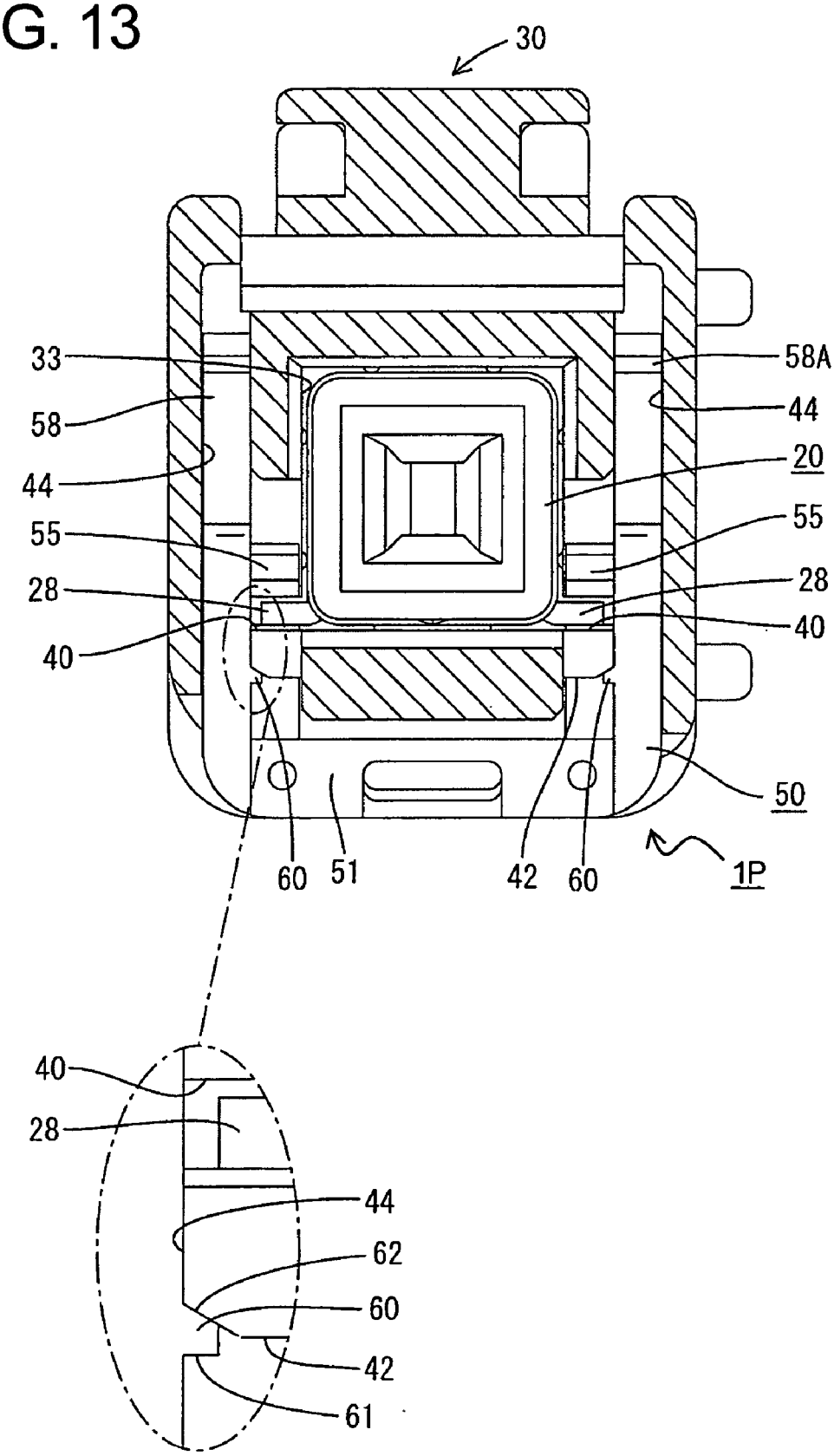
FIG. 13 is a front view in section showing the retainer at the partial locking position.

As described above, the locking projections 60 are retracted at corners between the retainer mount hole 42 and the insertion grooves 44 when the retainer 50 is at the partial locking position 1P of FIG. 13. On the other hand, the locking projections 60 fit in the guide grooves 40 when the retainer 50 is pushed in the mounting direction MD to the full locking position 2P of FIG. 15.

The space between the two locking projections 60 is set so that the stabilizers 28 of the terminal 20 are held tightly held from opposite sides.

The shielded terminal 20 secured to the end of the shielded wire 10 is inserted in the inserting direction ID into the cavity 31 of the female housing 30 while the retainer 50 is at the partial locking position 1P shown in FIGS. 12 and 13. At this time, the stabilizers 28 contact the opening edge of the entrance of the narrowed portion 32 and prevent further insertion of the shielded terminal 20 if the shielded terminal 20 is in an improper posture. Thus, the stabilizers 28 prevent an erroneous insertion.

The stabilizers 28 can enter the guide grooves 40 if the shielded terminal 20 is in its proper posture. Additionally, the retaining portions 54 of the retainer 50 are retracted from the guide grooves 40. Thus, the stabilizers 28 slide along the guide grooves 40 as the shielded terminal 20 is pushed in the inserting direction ID. Sufficient insertion causes the stabilizers 28 to deform the lock 35 in the deforming direction DD. Insertion of the shielded terminal 20 is stopped when the stabilizers 28 move beyond the retaining portions 54 and contact the back ends of the guide grooves 40, as shown in FIG. 11. As a result, the lock 35 restores, and the protrusion 36 of the lock 35 engages the locking edge 27 of the terminal 20 to achieve primary locking. Therefore, the lock 35 prevents the shielded terminal 20 from coming out the cavity 31.

The base plate 51 then is pushed in the mounting direction MD to move the retainer 50 towards the full locking position 2P, as shown by an arrow in FIG. 12. The legs 52 move up in the insertion grooves 44 while the full locking claws 58 are deformed and move up beyond the full locking sections 48. Simultaneously, the retaining portions 54 move up in the mounting direction MD substantially along the grooves 45 until the upper ends of the retaining portions 54 project into the guide grooves 40.

The stabilizers 28 remain at positions where the guide grooves 40 cross the vertical grooves 45 if the shielded terminal 20 is not pushed sufficiently along the inserting direction ID. Thus, the retaining portions 54 contact the stabilizers 28, and prevent further insertion of the retainer 50 in the mounting direction MD. In this way, insufficient insertion of the shielded terminal 20 is detected. In such a case, the shielded wire 10 can be pushed again.

Insertion of the shielded wire 10 could be only slightly insufficient, and tiny parts of the rear edges of the stabilizers 28 may still be in the vertical grooves 45. The retainer 50 is pushed towards the full locking position 2P to move the retaining portions 54 in the mounting direction MD. As a result, the slanted surfaces 54B at the upper front sides of the retaining portions 54 engage the rear edges of the stabilizers 28 to push the shielded terminal 20 forward in the inserting direction ID. Accordingly, the partial locking by the lock 35 is assisted and performed automatically.

Figure 15:
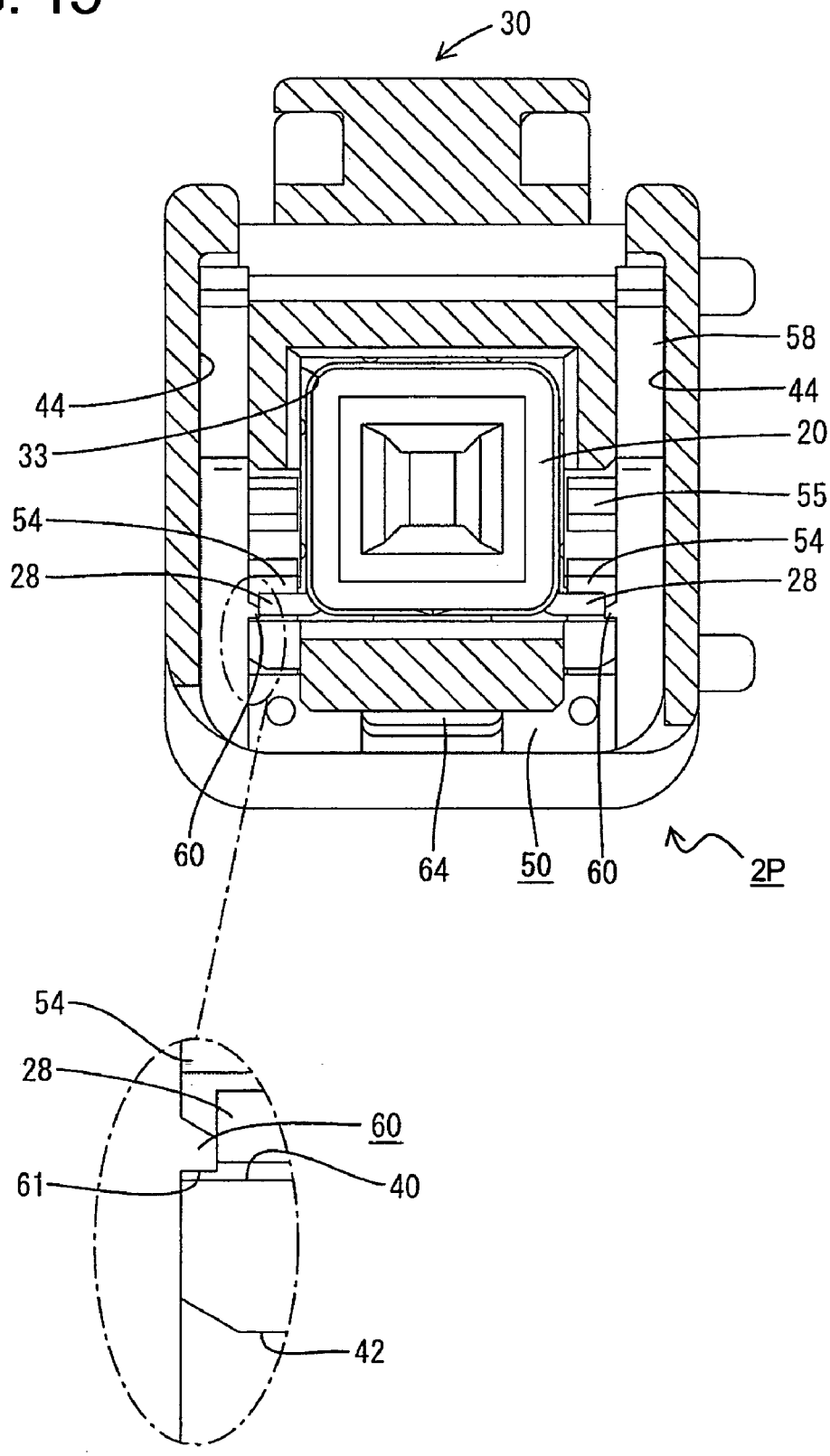
FIG. 15 is a front view in section showing the retainer at the full locking position.
Figure 16A:
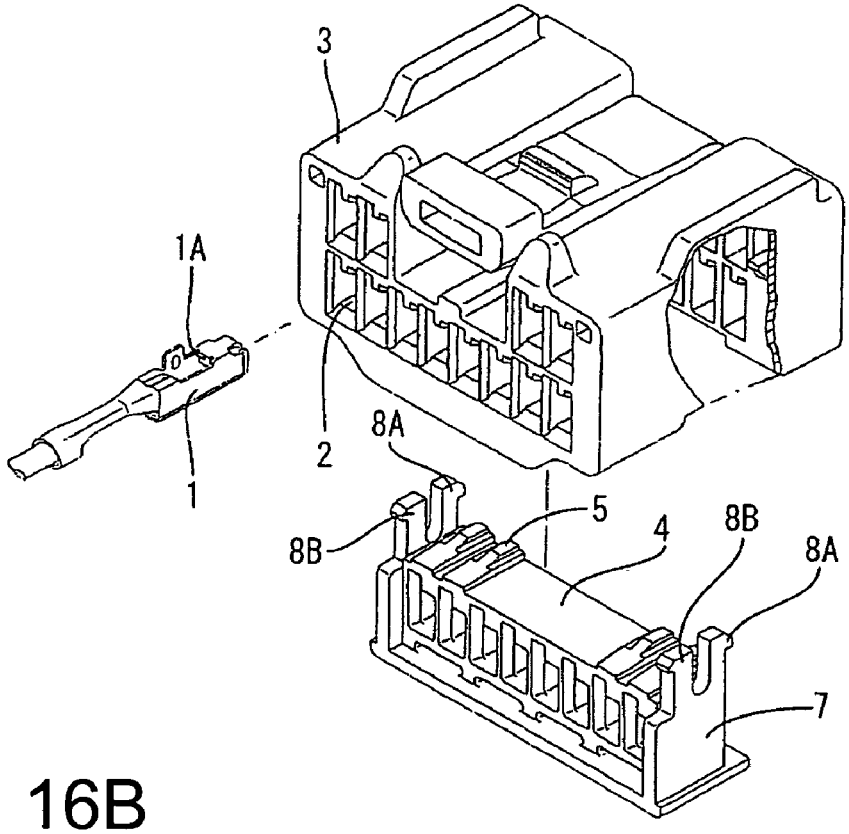
FIG. 16A PRIOR ART
FIG. 16A is an exploded perspective view of a prior art connector and FIG. 16B is a section of a locking mechanism for a retainer.
Figure 16B:
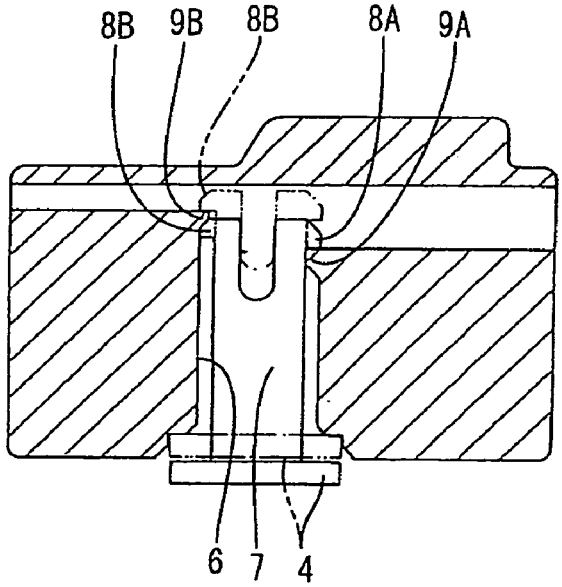
FIG. 16B PRIOR ART

The full locking claws 58 engage the full locking sections 48 when the retainer 50 is pushed to the full locking position 2P shown in FIG. 14. Simultaneously, as shown in FIG. 15, the locking projections 60 fit in the guide grooves 40 and the locking surfaces 61 engage the corresponding bottom surfaces of the guide grooves 40. Thus, the retainer 50 is locked strongly at the full locking position 2P so as not to come out.

Upper parts of the retaining portions 54 are in the guide grooves 40 and engage the rear edges of the stabilizers 28 when the retainer 50 is at the full locking position 2P. As a result, the shielded terminal 20 is locked doubly. The stabilizers 28 are held from opposite sides by the locking projections 60. Thus, the shielded terminal 20 is prevented from shaking and is substantially centered with respect to the width direction WD in the cavity 31.

The terminal 20 may have to be withdrawn from the cavity 31 for maintenance. Thus, a jig can be inserted into a jig insertion opening 64 in the front of the base plate 51 of the retainer 50 in a state of FIG. 14 to return the retainer 50 to the partial locking position 1P shown in FIGS. 11 and 12 while disengaging the full locking claw 58 from the full locking section 48 and withdrawing the locking projections 60 from the guide grooves 40. In this way, the retaining portions 54 move below the guide grooves 40 and the locked state of the retainer 50 is canceled.

A jig can be inserted into the cavity from the front to deform the lock 35 from the locking edge 27. The wire 10 then can be pulled to withdraw the shielded terminal 20 from the cavity 31 in a direction opposite to the inserting direction ID while the stabilizers 28 slide along the guide grooves 40.

As described above, the full locking claws 58 engage the full locking sections 48 and the locking projections 60 fit in the guide grooves 40 when the retainer 50 is pushed to the full locking position 2P. As a result, the retainer 50 is locked strongly at the full locking position and will not come out. The force needed to withdraw the retainer 50 from the full locking position 2P is higher than the force needed to move the retainer 50 from the partial locking position 1P towards the full locking position 2P. Further, the construction for fitting the locking projections 60 into the guide grooves 40 for the stabilizers 28 utilizes a dead space. Thus, the female housing 30 is not enlarged. In other words, the locking strength of the retainer 50, i.e. a locking force for the shielded terminal 20 is reinforced while keeping the connector small.

The stabilizers 28 of the shielded terminal 20 are held from opposite sides by the locking projections 60 fit in the guide grooves 40 when the retainer 50 is at the full locking position. Thus, the shielded terminal 20 is prevented from shaking and is centered along the width direction WD in the cavity 31. As a result, the connecting operation with a mating terminal can be performed smoothly and fine sliding abrasion with the mating terminal is prevented.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

An auxiliary locking mechanism for the retainer may have recesses in the surfaces of the legs of the retainer facing the cavity and projections on the facing surfaces of the insertion grooves into which the legs are inserted. Alternatively, the locking mechanism may have projections on either of the surfaces of the legs of the retainer facing sides opposite from the cavity and the facing surfaces of the insertion grooves and recesses in the others.

Left and right stabilizers are provided in the foregoing embodiment. However, only one of them may be provided. The present invention is also applicable to stabilizers projecting laterally, up or down.

The retainer may be mounted directly at the full locking position without being locked at the partial locking position.

Although the single-contact connector is illustrated in the foregoing embodiment, the invention is also applicable to a multi-contact connector accommodating a plurality of terminal fittings in a housing.

The retainer is not limited to the side type illustrated in the foregoing embodiment, and may be of the front type or the rear type depending on the shape and/or the specifications (e.g. in case of a watertight connector).

The invention is similarly applicable to male shielded connectors having male shielded terminals.

The invention is not limited to shielded connectors, and is similarly applicable to non-shielded connectors in which terminal fittings secured to ends of insulated wires are inserted into cavities of a housing.

The invention is applicable to connectors with terminals locked in the cavities only by the retainer and without assistance of a lock in the cavities.

What is claimed is:

1. A connector, comprising:

a housing formed with at least one cavity for receiving a terminal fitting;

a retainer insertable into the housing for retaining the terminal fitting and including at least one leg insertable into an insertion groove in a side wall of the cavity, a lock provided on the leg being resiliently engageable with an engaging portion in the insertion groove to lock the retainer at a locking position where the retainer retains the terminal fitting; and an auxiliary locking mechanism in the form of at least one projection and at least one recess formed on surfaces of the leg of the retainer substantially facing the cavity and on a facing surface of the insertion groove so that the projection and the recess are substantially facing each other, the projection being fittable into the recess and the projection and the recess being disposed to be engageable with each other when the retainer is inserted to the locking position.

2. The connector of claim 1, wherein the terminal fitting includes at least one stabilizer projecting outwardly, a guide groove for permitting insertion of the stabilizer being formed in a wall of the cavity and communicating with the insertion groove.

3. The connector of claim 2, wherein the recess is an end of the guide groove toward the insertion groove.

4. The connector of claim 2, wherein the guide groove is formed to become narrower when seen in an inserting direction of the terminal fitting into the cavity.

5. The connector of claim 1, wherein at least one of the projection and the stabilizer has a slanted surface disposed for contacting the other of the projection and the stabilizer if the terminal fitting is not in the properly inserted position, and wherein upon mounting the retainer to the locking position, the retainer pushes the terminal fitting towards the substantially properly inserted position and towards a wall of the cavity.

6. The connector of claim 1, wherein the retainer can be locked at a temporarily holding position before the locking position with respect to an inserting direction of the retainer where the insertion and withdrawal of the terminal fitting into and from the cavity are permitted.

7. A connector, comprising:

a housing formed with at least one cavity for receiving a terminal fitting, two insertion grooves being provided at lateral sides of the cavity, two stabilizers projecting to lateral sides from the terminal fitting, guide grooves for permitting insertion of the respective stabilizers being formed in opposite side walls of the cavity and communicating with the insertion grooves;

a retainer insertable into the housing for retaining the terminal fitting and including at least one leg insertable into an insertion groove in a side wall of the cavity, a lock provided on the leg being resiliently engageable with an engaging portion in the insertion groove to lock the retainer at a locking position where the retainer retains the terminal fitting; and an auxiliary locking mechanism in the form of at least one projection and at least one recess formed on surfaces of the leg and the insertion groove substantially facing each other and engageable with each other when the retainer is inserted to the locking position, and the projections of both legs are fit into the corresponding guide grooves to hold both stabilizers from substantially opposite sides when the retainer is inserted to the locking position.

8. A connector, comprising:

a housing at least one cavity, opposed guide grooves in opposed side walls of the cavity, insertion grooves in the side walls of the cavity and intersecting the respective guide grooves, an engaging portion in each of the insertion grooves;

a terminal fitting insertable in the cavity, stabilizers projecting from the terminal fitting and being insertable in the guide grooves, each of the stabilizers having a rear edge;

a retainer insertable into the housing and including legs insertable into the insertion grooves of the housing, a lock provided on each of said legs and being resiliently engageable with the engaging portion in the respective insertion groove to lock the retainer at a locking position, a retaining portion on each of said legs for engaging the rear edge of one of said stabilizers for holding the terminal fitting in the cavity, projections formed on surfaces of the legs substantially facing each other and engageable in the guide grooves when the retainer is at the locking position.

9. The connector of claim 8, wherein the projections engaging the stabilizers from opposite sides for centering the terminal fitting in the cavity.

10. The connector of claim 9, wherein the stabilizers are in the insertion grooves when the terminal fitting is inserted insufficiently for interfering with the retainer.

* * * * *